US006847307B2

(12) United States Patent
Thao et al.

(10) Patent No.: US 6,847,307 B2
(45) Date of Patent: Jan. 25, 2005

(54) TRAFFIC SIGNAL CONTROL SYSTEM EMPLOYING UNIVERSAL CO-ORDINATED TIME (UTC) OF GPS AS TIME BASE

(76) Inventors: Chun Hao Thao, PO Box 82-114, Taipei (TW); Szu Chin Chang, PO Box 82-144, Taipei (TW)

( * ) Notice: Subject to any disclaimer, the term of this patent is extended or adjusted under 35 U.S.C. 154(b) by 112 days.

(21) Appl. No.: 10/156,128

(22) Filed: May 29, 2002

(65) Prior Publication Data

US 2003/0222790 A1 Dec. 4, 2003

(51) Int. Cl.[7] ..... G08G 1/095

(52) U.S. Cl. ..... 340/907; 340/911; 340/913

(58) Field of Search ..... 340/907, 908, 340/909, 910, 911, 913, 917, 924, 931; 368/47; 701/117

(56) References Cited

U.S. PATENT DOCUMENTS

| | | | | | |
|---|---|---|---|---|---|
| 5,416,808 | A | * | 5/1995 | Witsaman et al. | 375/350 |
| 5,510,797 | A | * | 4/1996 | Abraham et al. | 342/352 |
| 5,625,556 | A | * | 4/1997 | Janky et al. | 342/357 |
| 6,133,854 | A | * | 10/2000 | Yee et al. | 340/907 |
| 6,192,007 | B1 | * | 2/2001 | Aoshima | 368/10 |
| 6,370,159 | B1 | * | 4/2002 | Eidson | 370/503 |
| 6,525,995 | B1 | * | 2/2003 | Diehl et al. | 368/47 |

* cited by examiner

*Primary Examiner*—Brent A. Swarthout
(74) *Attorney, Agent, or Firm*—Leong C. Lei

(57) ABSTRACT

A traffic signal control system employing universal coordinated time of GPS as time base. The control system includes a core system for receiving Universal Coordinated Time (UTC) data of GPS and incorporating longitude and latitude data so as to convert the data to local time. This time is used as common time base for all traffic signal system. The control system further comprises a basic input/output system and a selective secondary system. The present system is a high stability disperse type traffic signal control system.

1 Claim, 9 Drawing Sheets

TRAFFIC SIGNAL CONTROL SYSTEM EMPLOYING UNIVERSAL CO-ORDINATED TIME (UTC) OF GPS AS TIME BASE

BACKGROUND OF THE INVENTION (a) Field of the Invention

The present invention relates to a traffic signal control system employing universal coordinated time of GPS as time base. The present system is applicable to traffic signal linkage control in cities.

(b) Description of the Prior Art

In conventional system for central linkage control, the system employs a control center as the system spine thereof, and the traffic light signals are connected to the system spine by wires or wireless circuits so as to execute the lighting of the individual light signal. The application of a closed loop mechanism theoretically provides good control effectiveness and thereof, this system is commonly used in cities all around the world. However, this system requires expensive maintenance and the system does not have intrinsic stability. Occasionally, the system is damaged as a result of natural disastrous, such as typhoon, earthquake. Accordingly, it is an object of the present invention to provide a traffic signal control system employing universal coordinated time of GPS as time base, wherein the above drawbacks are mitigated, and provides a system which requires low maintenance and high intrinsic stability.

SUMMARY OF THE INVENTION

Accordingly, it is an object of the present invention to provide a traffic signal control system employing universal coordinated time (UTC) of CPS as time base comprising a core system for receiving UTC data of GPS, and to include longitude and latitude data and to convert the information to local time as a common time basis for the traffic signal control system.

Yet another object of the present invention is to provide a traffic signal control system employing universal coordinated time of GPS as time base, wherein the basic input/output system includes manual control device, manual data output/input device, and calculation device for rectified phase of light signal switching.

Yet another object of the present invention is to provide a traffic signal control system employing universal coordinated time of GPS as time base, wherein the selective secondary system includes (a) uninterrupted current system constituted from diodes light source;

(b) fine turning system constituted from vehicle flow rate sensors;

(c) remote controlled reset system for non-synchronized batch loading and unloading transmission by beehive type wireless telephone.

The advantages of the present system are:

(1) No real time center linking system is required. Therefore, start-up and maintenance fees are therefore not required and cost of operation is greatly reduced;

(2) The stability of the control system is high. The system is operable anytime and at anywhere, i.e., independent of natural disastrous.

(3) The control system is functionally extendable and is applicable to incorporation of a secondary system.

The foregoing object and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PRESENT INVENTION

The following descriptions are of exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
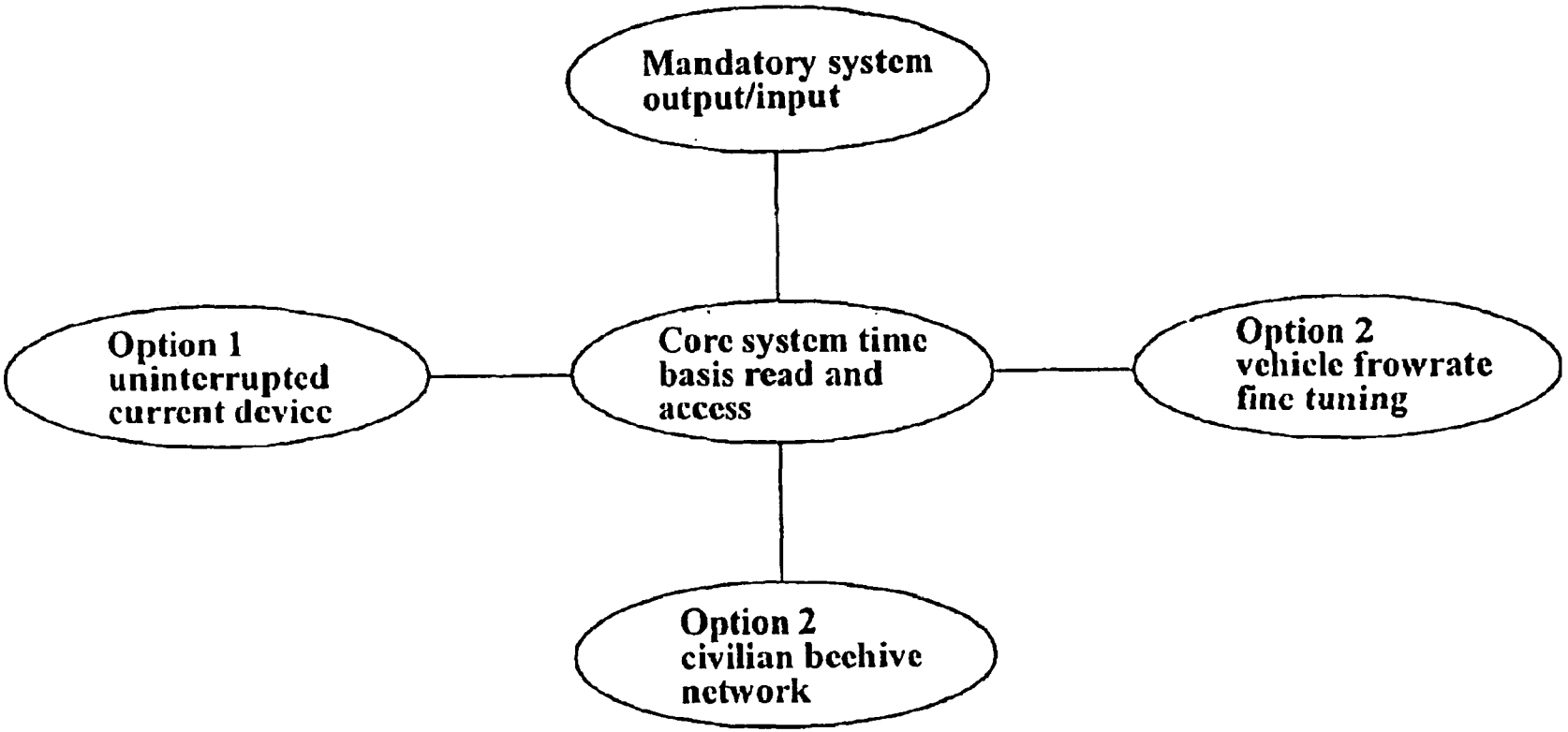
FIG. 1 is a schematic diagram showing traffic light signal control system in accordance with the present invention.
Figure 2:
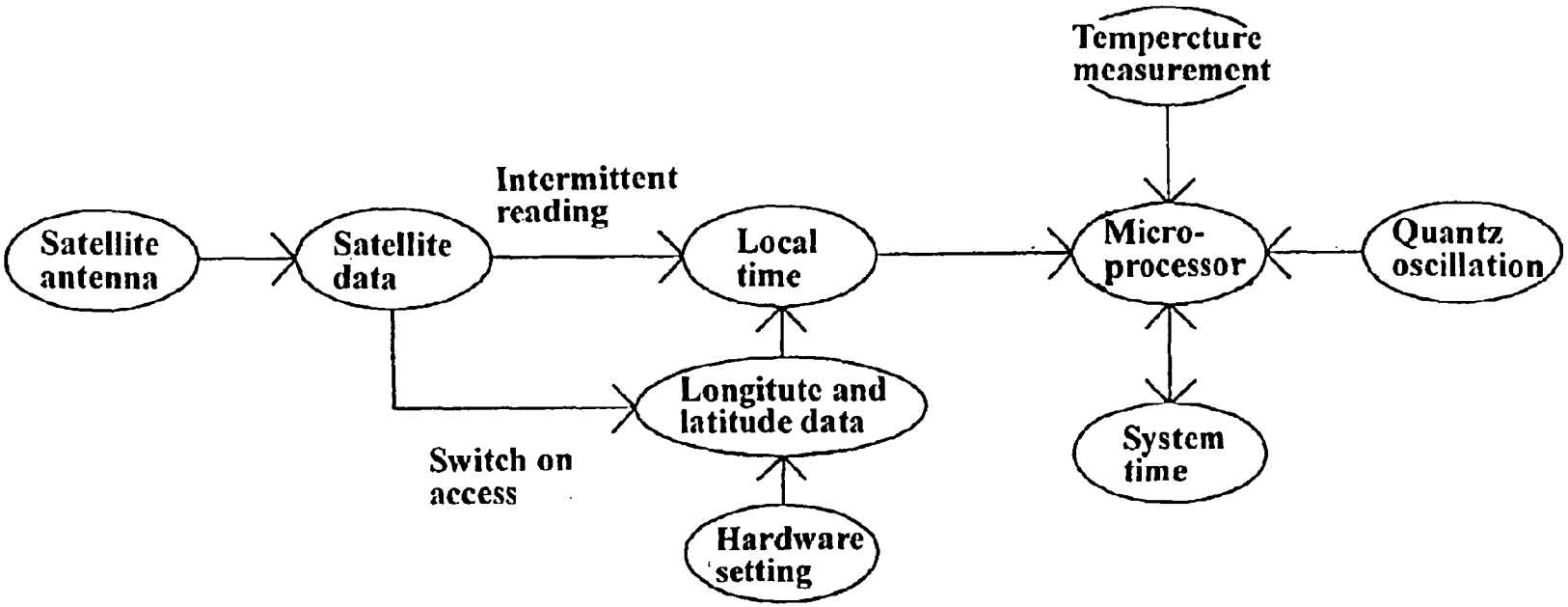
FIG. 2 is a schematic flow chart of the core system in accordance with the present invention.

Referring to FIG. 1, there is shown a traffic signal control system employing universal coordinated time of GPS as time base comprising a core system (as shown in FIG. 2) which is a read and access system for UTC of the GPS, the accumulative error being less than 100 mSec, and a microprocessor is used to read time data of the GPS and longitude and latitude data are incorporated. These data are converted into local time and then, are used to calibrate system time of the microprocessor. After the calibration has been completed, the power sources to the analog and digital processor are cut off. After a period of few hours, the power sources are switched ON and calibration is performed again. Accordingly, the error of the system time can be corrected to fall with 100 mSec. This time basis is applied to the control procedures of the entire traffic signal system. The frequency of the Quartz Oscillator of the system can be calibrated by such means by microprocessor after incorporating a temperature measuring circuit to largely extend the interval time of satellite calibration. This will increase the stability of the time basis of the system, or reduce the working time of the satellite reception circuit.

In accordance with the present invention, the control system further comprises a basic output/input system and a selective secondary system forming into a disperse type control system.

Figure 3:
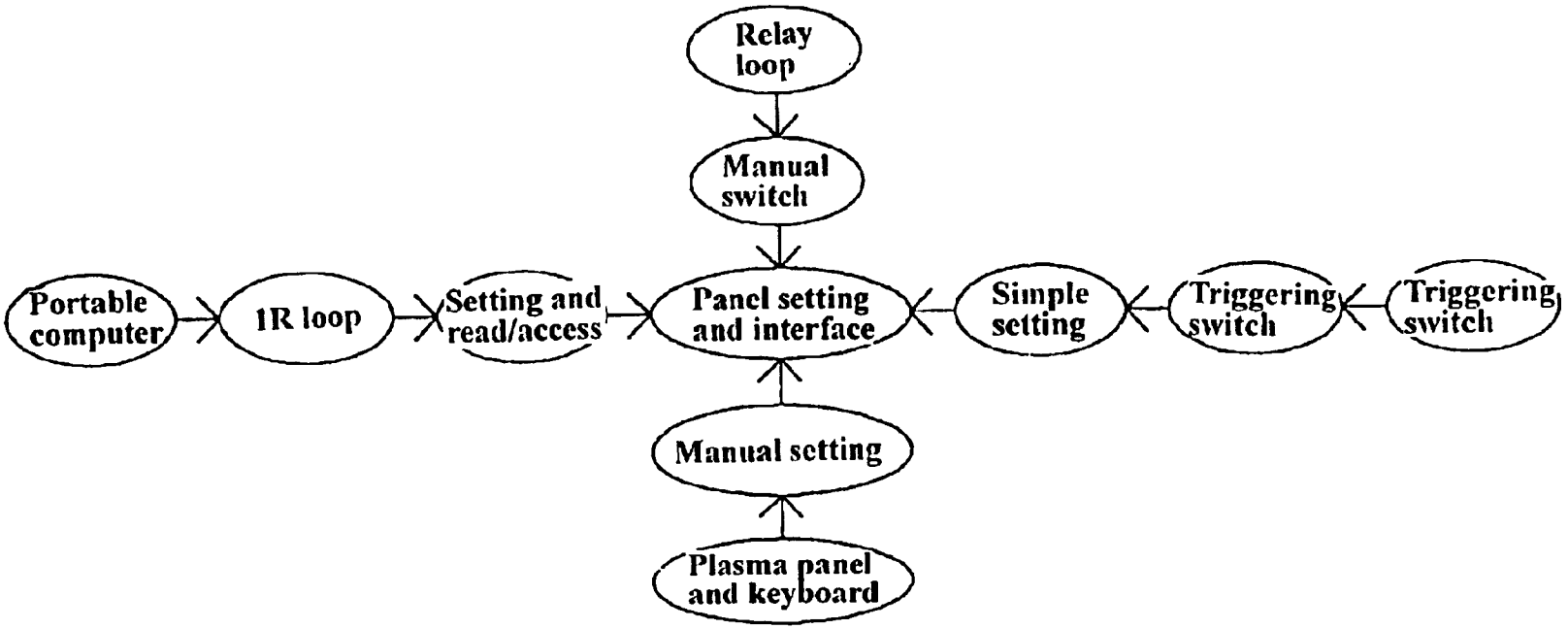
FIG. 3 is a basis output/input system flow chart of FIG. 1.

Referring to FIG. 3, the output/input system includes a manual control device having a relay to improve reliability of the manual system. The manual data output/input device includes IR receiving and transmitting device installed on a housing. Computer can perform the entire setting of the device. A plasma display and a waterproof keyboard can be installed. In accordance with the present invention, the rectified phase of traffic light signal switch is carried out by synchronized all the signal light of the adjacent systems. This method is by increasing a new parameter for rectified phase for traffic light switch. The method of calculation is as follows;

Step 1: dividing 86400 seconds by the period of the traffic light to obtain an integer.

Step 2: Rounding up the integral into a whole number.

Figure 4:
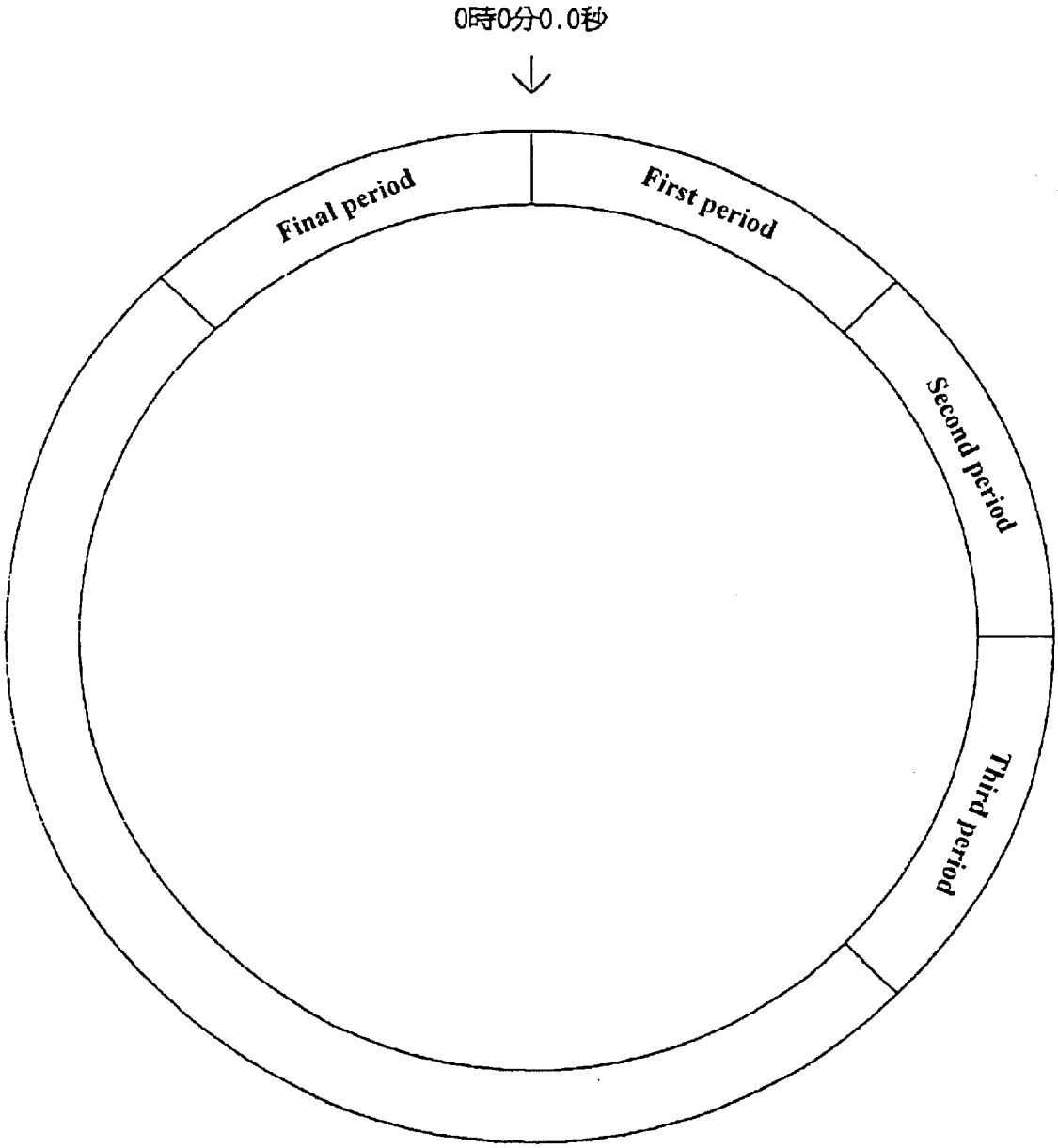
FIG. 4 shows a schematic view for calculation of rectified phase of light signal switch in accordance with the present invention.

Accordingly, as shown in FIG. 4, the time for one day is divided into preset time interval. Each time interval is divided into rectified phase of 360 degree. Accordingly, when the traffic light signals has the same period, and same rectified phase the result is that the signals are either ON or OFF at the same time.

Figure 5:
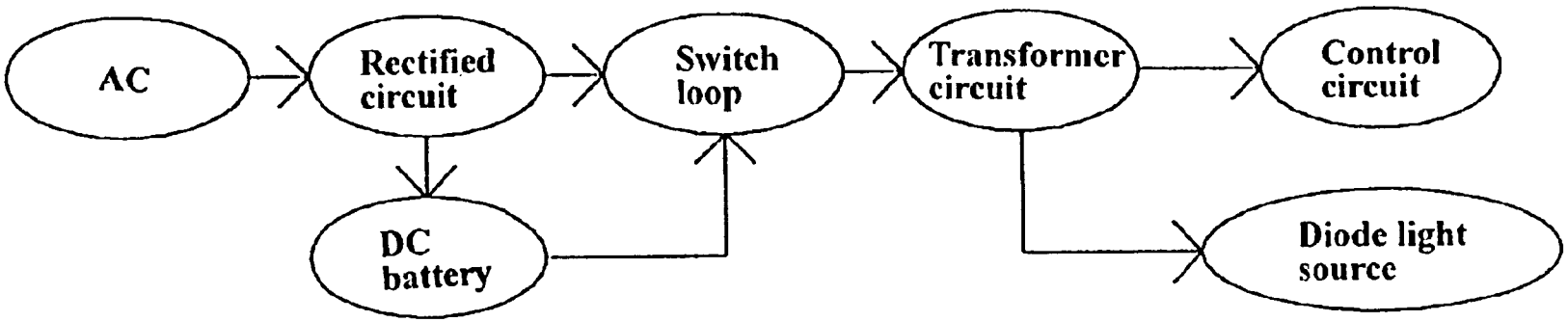
FIG. 5 illustrates block diagram for diode uninterrupted current device of the present invention.

The selective secondary system comprises:

(a) uninterrupted current system (as shown in FIG. 5) having diodes light source. The maintenance time is set at 72 hr.

Figure 6:
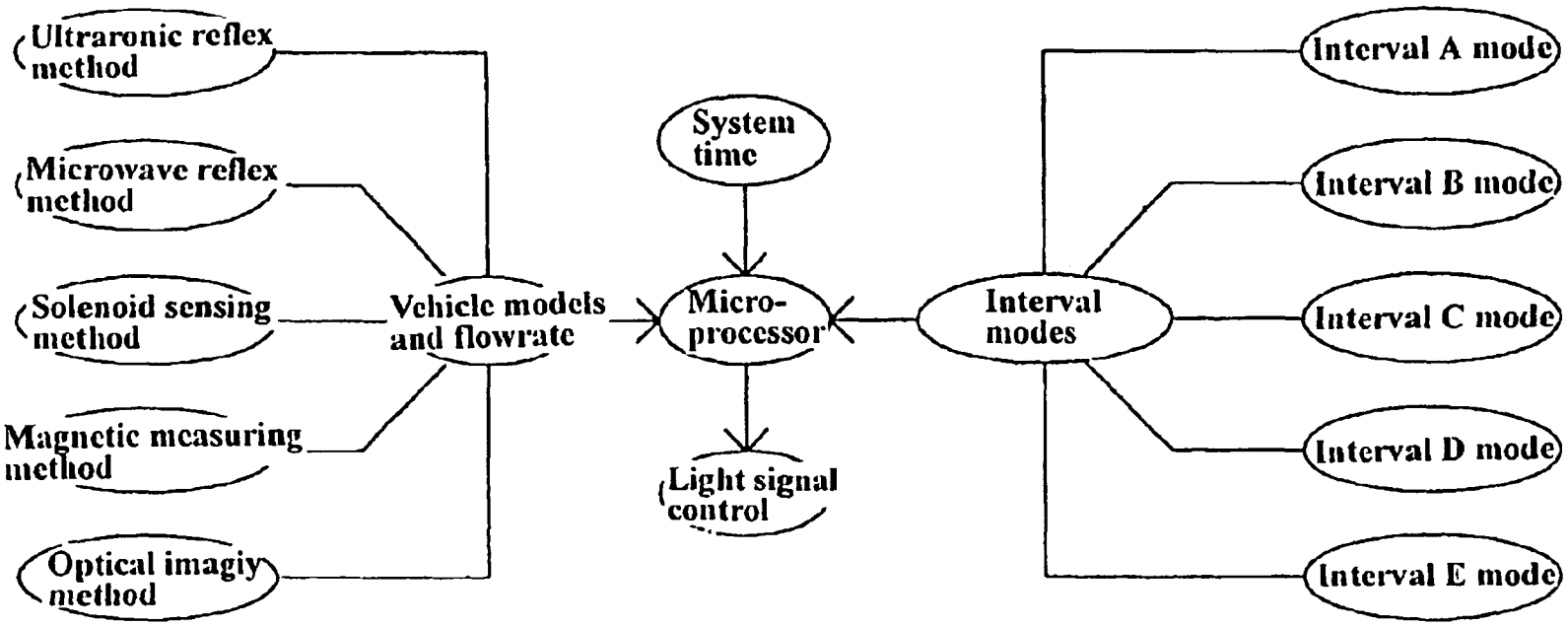
FIG. 6 illustrates block diagram for vehicle flow rate sensing fine tuning system.

(b) fine turning system (as shown in FIG. 6) constituted from vehicle sensors. Sensors are used to register the flowrate of vehicles and the flowrate is determined by the microprocessor. Based on the control mode for traffic light signal a preset mode is automatically executed.

Figure 7:
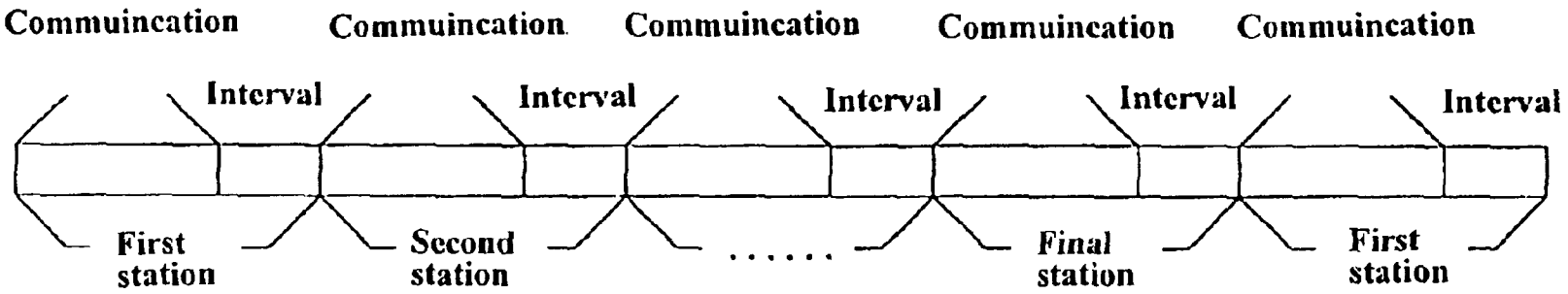
FIG. 7 is a schematic view showing communication interval planning for data loading and unloading in accordance with the present invention.
Figure 8:
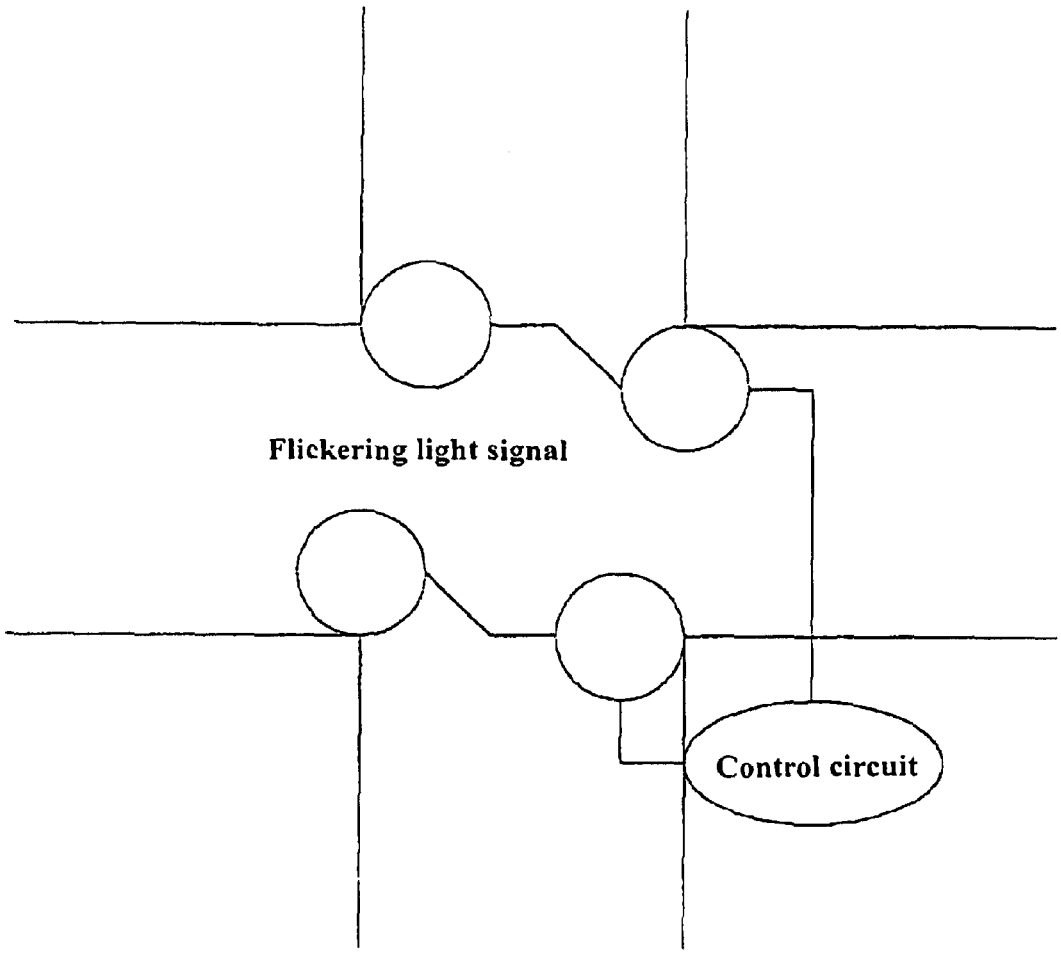
FIG. 8 illustrates the conventional single light flickering control device.
Figure 9:
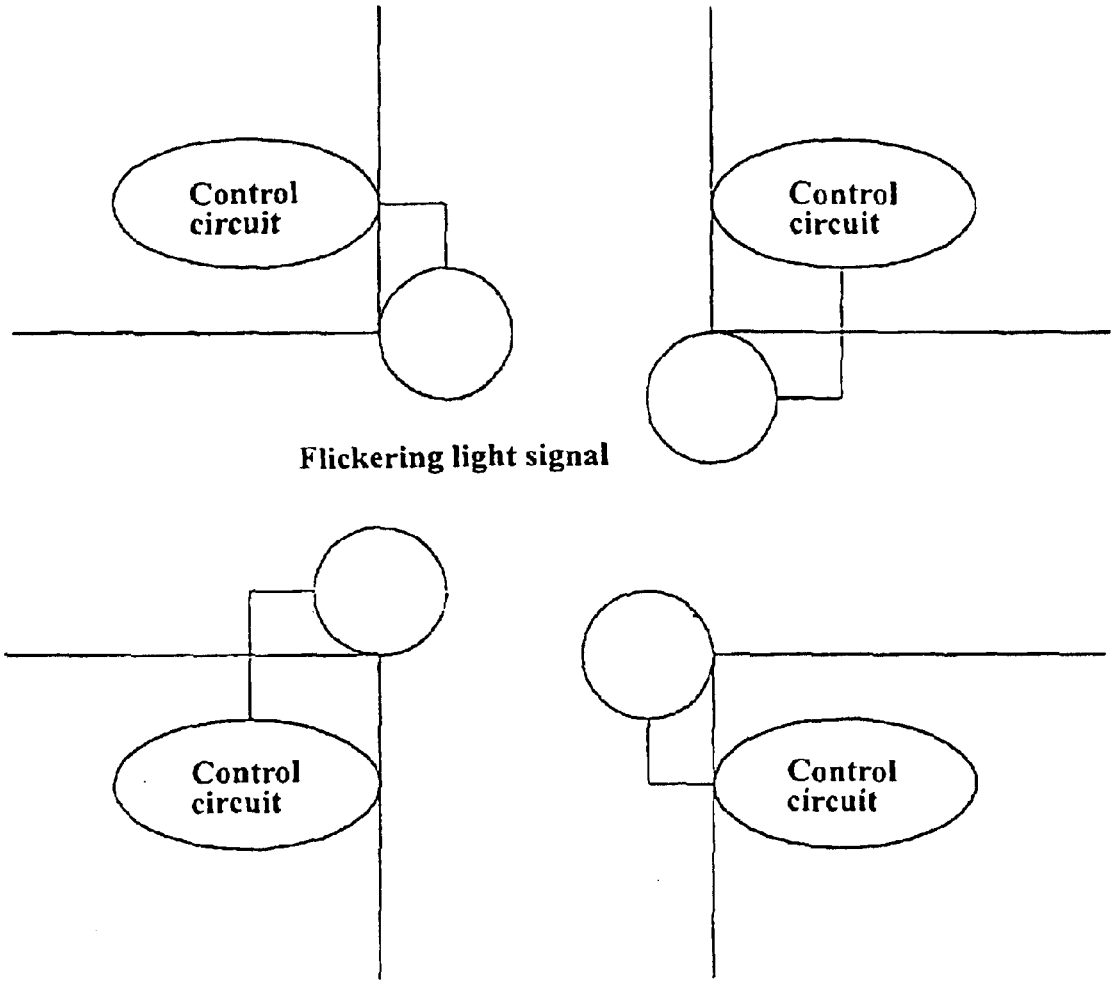
FIG. 9 illustrates synchronous flickering device by employing the present system.

(c) A remote control re-new setting system for non-synchronous batch data loading and unloading by means of beehive wireless telephone. This system can be provided to multiple light signals (generally 1 to 10) for one telephone number (as shown in FIG. 7).

Generally, a 24 hours for one day are divided into a multiple intervals and one interval is about 10 to 15 minutes as a basis. This includes ⅔ of the communication interval and ⅓ of free interval so that the signal station can appropriately use the transmitted data time interval. This method employs the public communication network without installation of specific transmission wires.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

What is claimed is:

1. A traffic signal control system employing universal coordinated time (UTC) of OPS as time base comprising: a core system for receiving data of GPS, and to include longitude and latitude data and to convert information to local time as a common time basis for the traffic signal control system; a basic input/output system including a manual control device, manual data input/output device, and a means of calculating rectified phase of a light signal switching; a selective secondary system including (a) a diode light source uninterrupted system, (b) a fine tune system, and (c) beehive wireless telephone system used as a non-synchronized batch type loading wireless re-new setting system to form a complete disperse system control system; wherein the manual control device of the basic input/output system is a relay, the manual data input/output device is a box containing IR receiving and transmitting device which is set by portable computer following an interface, the means of calculating rectified phase is added with a new rectified phase for light signal switching control parameter so that traffic signals synchronize at the same time, the beehive wireless telephone system divides 24 hour of a day into a plurality of interval, each interval being 10–15 minutes as a basis, including ⅔ being communication time interval and ⅓ being free interval.

* * * * *